US005490188A

United States Patent [19]

Snyder

[11] Patent Number: 5,490,188

[45] Date of Patent: Feb. 6, 1996

[54] SYSTEM AND METHOD FOR EVAPORATING MOISTURE FROM A GAP DEFINED BETWEEN A REPAIR SLEEVE AND A SURROUNDING HEAT TRANSFER TUBE IN A NUCLEAR STEAM GENERATOR

[75] Inventor: David A. Snyder, North Huntingdon, Pa.

[73] Assignee: Westinghouse Electric Corporation, Pittsburgh, Pa.

[21] Appl. No.: 366,644

[22] Filed: Dec. 30, 1994

[51] Int. Cl.[6] ..... G21C 19/00

[52] U.S. Cl. ..... 376/310; 34/439; 29/890.031; 228/205

[58] Field of Search ..... 376/260, 308, 376/310, 313, 314; 29/890.031, 890.036, 890.054, DIG. 44, DIG. 84, 523; 34/104, 439; 165/5, 76, 95; 228/205, 119

[56] References Cited

U.S. PATENT DOCUMENTS 4,448,343 5/1984 Kochka et al. ..... 228/205
4,783,890 11/1988 Gaudin ..... 29/890,031

OTHER PUBLICATIONS

"IMD 5000 Instruction Manual", by Graham–White Manufacturing Company, 1990.

*Primary Examiner*—Daniel D. Wasil
*Attorney, Agent, or Firm*—Walter S. Stevens

[57] ABSTRACT

System and method for evaporating moisture from a gap defined between a heat transfer tube surrounding a repair sleeve in a nuclear steam generator. The nuclear steam generator has a heat transfer tube surrounding a repair sleeve that has been hydraulically expanded into engagement with the tube. The tube and the sleeve define a gap therebetween having moisture residing therein. The system includes an air compressor in communication with the gap for supplying air to the gap and a dryer in communication with the air compressor for drying the gas supplied to the gap. A heater in communication with the air compressor may also be provided for heating the air supplied to the gap, so that the moisture residing in the gap evaporates into the heated air. A vacuum pump in communication with the gap may be provided for decreasing the pressure of the heated air in the gap, so that substantially all the moisture evaporates from the gap and into the heated air.

19 Claims, 3 Drawing Sheets

SYSTEM AND METHOD FOR EVAPORATING MOISTURE FROM A GAP DEFINED BETWEEN A REPAIR SLEEVE AND A SURROUNDING HEAT TRANSFER TUBE IN A NUCLEAR STEAM GENERATOR

BACKGROUND OF THE INVENTION

This invention generally relates to moisture removal from vessels and more particularly relates to a system and method for evaporating moisture from a gap defined between a first tubular member, such as a heat transfer tube, surrounding a second tubular member, such as a repair sleeve, in a nuclear steam generator.

Occasionally, nuclear steam generator heat transfer tubes may degrade and thus may not remain leak-tight. If through-wall cracking occurs due to the degradation, the radioactive primary fluid flowing through the tubes may leak through the crack and commingle with the nonradioactive secondary fluid surrounding the tubes, a highly undesirable result.

However, the degraded tube may remain in service by sleeving the degraded portion of the tube. When sleeving is performed, a tubular repair sleeve is inserted into the heat transfer tube to span or cover the degraded portion of the tube. The sleeve is then radially expanded into intimate engagement with the wall of the tube to secure the sleeve to the tube. The radial expansion of the sleeve may be accomplished by means of an hydraulic expansion mandrel, such that a sleeve-to-tube hydraulic expansion joint is defined where the sleeve has been expanded into engagement with the tube.

However, after hydraulic expansion, a small annular gap (e.g., approximately 0.012 inch) may nonetheless exist between the sleeve and the wall of the tube and may extend from the top end of the sleeve to a few inches (e.g., approximately six inches) below the top end of the sleeve. Thus, due to the presence of the annular gap, the sleeve will not engage the tube from the top end of the sleeve to that point which is a few inches below the top end of the sleeve. In other words, the sleeve will intimately engage the tube only starting at a transition region thereof beginning a few inches below the top end of the sleeve (termed herein "the hydraulic expansion transition region").

However, it has been observed that during subsequent operation of the steam generator, additional cracking may initiate in the surface of the heat transfer tube near the region of the hydraulic expansion transition region. Therefore, a portion of the hydraulic expansion transition region is further hydraulically expanded into engagement with the inside surface of the tube to cover such additional cracking.

After the previously mentioned expansion of the hydraulic expansion transition region is accomplished, a suitable welding device, such as a laser welding device, may then be inserted into the sleeve to weld the sleeve to the tube at the hydraulic expansion transition region. In this manner, the welding device sealingly affixes the sleeve to the tube.

It is important to sealingly affix the sleeve to the tube in order to prevent commingling the nonradioactive secondary fluid with the radioactive primary fluid. However, the gap and the cracks in the inside surface of the tube will typically contain moisture in the form of liquid water or a steam/water mixture. It is known that the presence of significant amounts of moisture in the gap and cracks will interfere with satisfactorily welding the sleeve to the tube.

Therefore, it is desirable to evaporate (i.e., boil) or otherwise remove the moisture from the gap (including tube wall cracks), before the hydraulic expansion transition region is expanded into engagement with the tube wall which occurs prior to welding the sleeve to the tube. This is important in order to obtain a satisfactory weldment after expansion. If a satisfactory weldment is not obtained, the weldment may have to be ground-out and reapplied. On occasion, the weldment may have to be repeatedly reapplied due to persistent moisture in the gap (including cracks). This is undesirable because repeated rewelding of the hydraulic expansion joint may cause unacceptable delay in returning the steam generator to service. Delay in returning the steam generator to service is not cost-effective because each day of delay in returning the steam generator to service costs the reactor owner approximately $500,000 per day in replacement power costs. Consequently, it is desirable to remove or evaporate substantially all the moisture from the gap in order to form a quality weldment the first time a weldment is attempted.

Therefore, what is needed are a system and method for evaporating moisture from a gap defined between a first tubular member, such as a heat transfer tube, surrounding a second tubular member, such as a repair sleeve, in a nuclear steam generator.

SUMMARY

The invention in its broad form is, for use in association with a vessel belonging to a nuclear steam supply system, the vessel having a first tubular member disposed therein surrounding a second tubular member, the first tubular member and the second tubular member defining a gap therebetween having moisture residing therein, a system for evaporating the moisture from the gap, comprising gas supply means in communication with the gap for supplying a gas to the gap; and dryer means in communication with said gas supply means for drying the gas supplied to the gap.

The invention in its broad form is also, for use in association with a vessel belonging to a nuclear steam supply system, the vessel having a first tubular member disposed therein surrounding a second tubular member, the first tubular member and the second tubular member defining a gap therebetween having moisture residing therein, a method of evaporating the moisture from the gap, comprising the steps of supplying a gas to the gap by operating a gas compressor in communication with the gap; and drying the gas supplied to the gap by operating a dryer in communication with the gas compressor.

An object of the present invention is to provide a system and method for evaporating moisture from a gap defined between a first tubular member, such as a heat transfer tube, surrounding a second tubular member, such as a repair sleeve, in a nuclear steam generator.

A feature of the present invention is the provision of a dryer in communication with an air compressor for drying the air supplied to the gap (including cracks) by the air compressor.

Another feature of the present invention is the provision of a vacuum pump in communication with the gap for decreasing the pressure of the air in the gap (including cracks), so that substantially all the moisture evaporates from the gap and into the air as the pressure decreases.

An advantage of the present invention is that substantially all the moisture in the gap is evaporated in order to allow formation of a quality weldment joining the sleeve to the tube the first time the weldment is attempted.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENT

Figure 1:
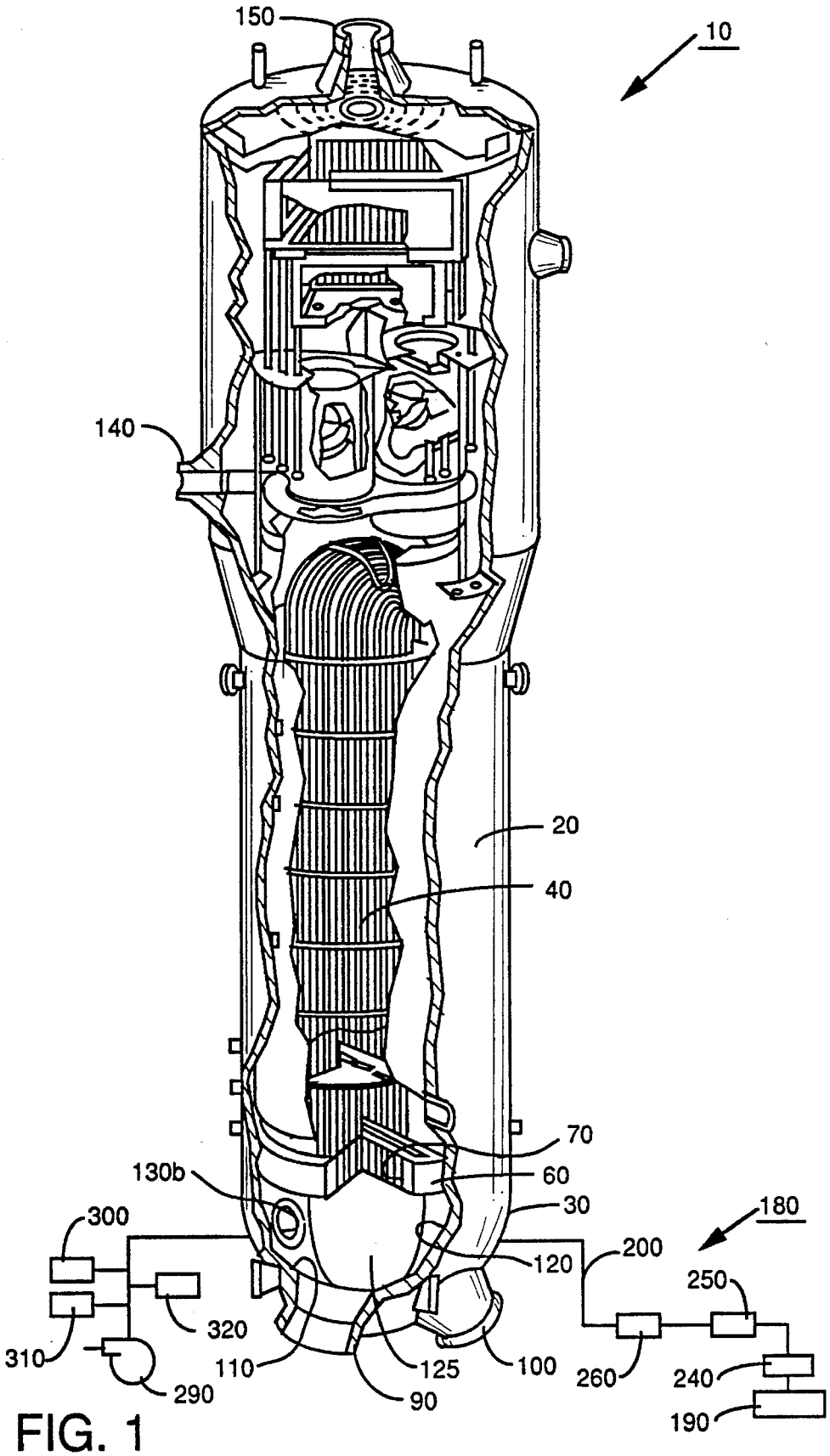
FIG. 1 is a perspective view in partial vertical section of a typical nuclear steam generator with parts removed for clarity, the steam generator having a plurality of U-shaped heat transfer tubes disposed therein, the tubes having ends thereof received through holes in a tubesheet.
Figure 2:
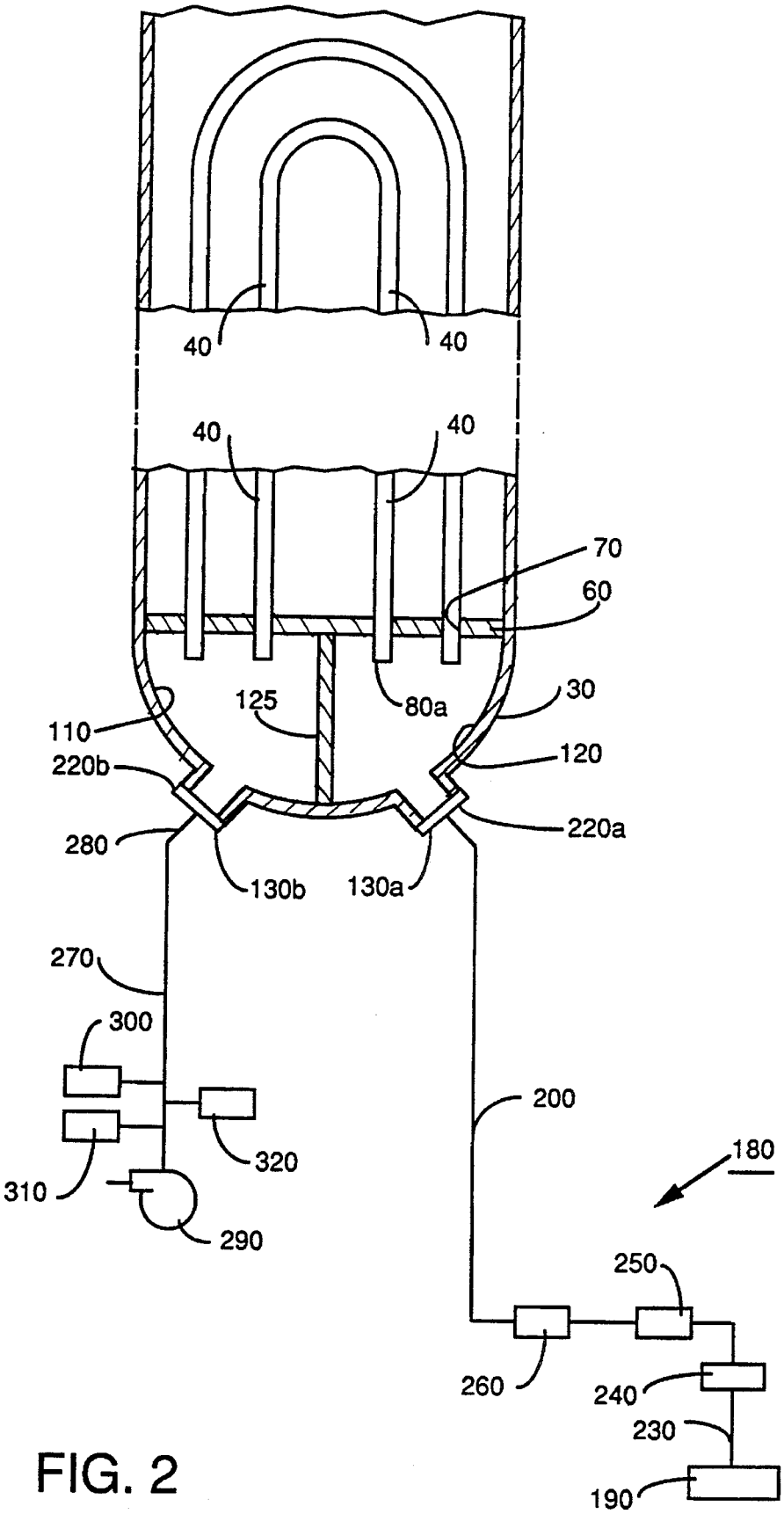
FIG. 2 illustrates the system of the invention connected to the steam generator.

Referring to FIGS. 1 and 2, there is shown a typical nuclear steam generator or heat exchanger, generally referred to as 10, for generating steam. Steam generator 10 comprises a shell 20 having a bowl-shaped (i.e., hemispherical) lower portion 30. Disposed in shell 20 are a plurality of vertical U-shaped heat transfer tubes 40. Each tube 40 has an inner surface 50 (see FIG. 3). Referring to FIGS. 1 and 2, disposed in lower portion 30 is a horizontal tubesheet 60 having holes 70 therethrough for receiving first open tube ends **80*a* and second open tube ends 80*b*. Attached to shell 20 are a first inlet nozzle 90 and a first outlet nozzle 100 in fluid communication with an inlet plenum chamber 110 and with an outlet plenum chamber 120, respectively. Inlet plenum chamber 110 and outlet plenum chamber 120 are located beneath tubesheet 60 and are isolated from each other by a divider plate 125. A first manway hole 130*a* and a second manway hole 130*b* are formed through lower portion 30 below tubesheet 60 for allowing access to outlet plenum chamber 120 and inlet plenum chamber 110, respectively. Moreover, attached to shell 20 above tubesheet 60 is a second inlet nozzle for entry of a non-radioactive secondary fluid (i.e., demineralized water) into shell 20. A second outlet nozzle 150 is attached to the top of shell 20 for exit of steam from steam generator 10**.

Occasionally, however, some of the tubes 40 may degrade and thus may not remain leak-tight. If a tube 40 degrades, it may nonetheless remain in service by suitably sleeving tube 40 in the manner disclosed hereinbelow.

Figure 3:
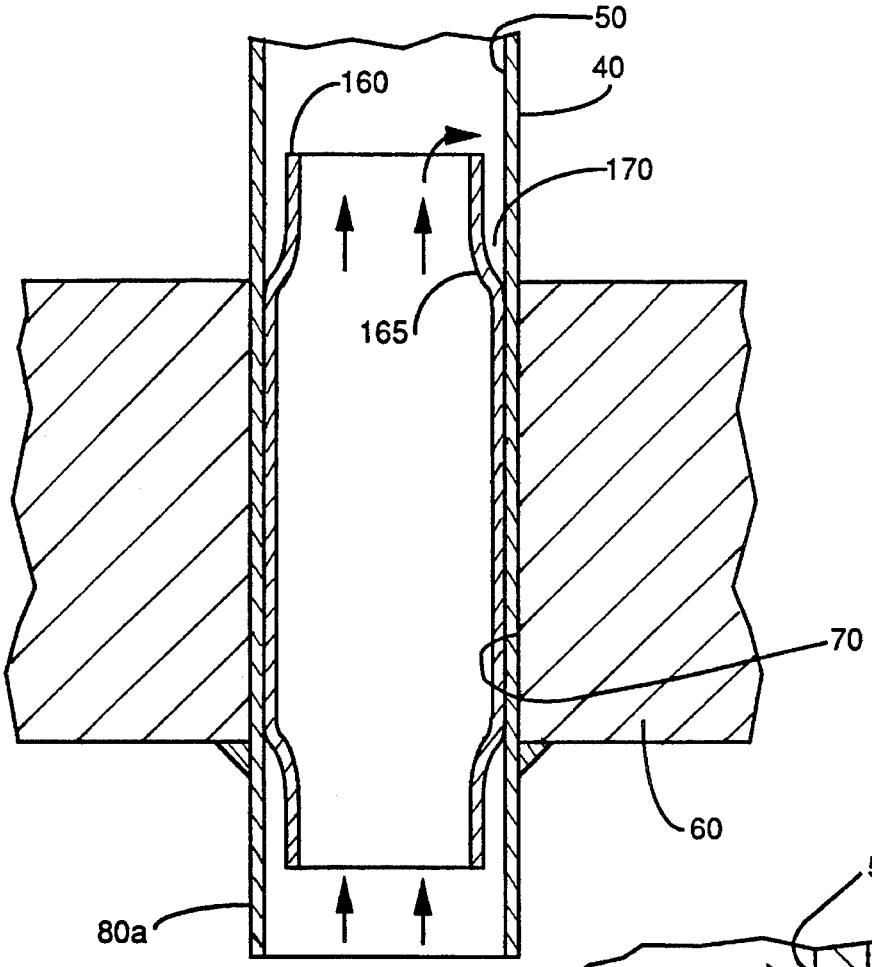
FIG. 3 shows in vertical section an end of one of the heat transfer tubes, the end of the tube having a repair sleeve hydraulically expanded into engagement therewith to define an annular gap between the sleeve and the tube, the annular gap having moisture (not shown) residing therein.

As best seen in FIG. 3, a tubular sleeve 160, which has been previously expanded into intimate engagement with inside surface 50 of the tube 40, is shown concentrically disposed in tube 40. Expansion of sleeve 50 may have been accomplished by means of a hydraulic expansion mandrel (not shown) to form a hydraulic expansion joint joining sleeve 160 and tube 40, the expansion joint in turn defining a "hydraulic expansion transition region" 165. After the hydraulic expansion joint has been formed, tube 40 and sleeve 160 will nonetheless define an annular gap 170 therebetween beginning at the top end of sleeve 160 and extending downwardly to the hydraulic expansion transition region 165. However, applicant has observed that during subsequent operation of the steam generator, additional cracking may initiate in inside surface 50 of tube 40 in the region of hydraulic expansion transition region 165. Therefore, the upper portion of sleeve 160, including hydraulic expansion transition region 165 itself, is hydraulically expanded to cover the previously mentioned additional cracks that occur in inside surface 50 of tube 40. A suitable welding device, such as a laser welding device (not shown), may then be inserted into sleeve 160 for placing a weldment around the upper end of sleeve 160 in order to sealingly affix sleeve 160 to tube 40.

However, applicant has observed that moisture in the form of liquid water, steam or a liquid water/steam mixture may reside in gap 170 (and any cracks in inside surface 50) prior to welding sleeve 160 to tube 40. This occurs because after steam generator 10 is removed from service and the primary fluid is drained from tubes 40, some water or moisture may nonetheless remain in gap 170 (and any cracks in inside surface 50).

Applicant has observed that moisture residing in gap 170 may undesirably interfere with satisfactorily laser welding sleeve 160 to tube 40. That is, the moisture will interfere with obtaining a quality weldment because when moisture and/or liquid water is trapped or confined within a closed chamber it will flash to steam during addition of heat from the welding process. This heat causes the water to vaporize and increase the internal pressure within the gap 170. The puddle of molten metal created by the welding process will be "blown away" from the weld joint thereby leaving a hole or inclusion that results in porosity. The quality of any weldment is measured by the amount of porosity it contains. Of course, increased porosity weakens the weld joint.

Moreover, applicant has discovered that moisture residing in gap 170 after sleeve 160 has been welded to tube 40 may increase the likelihood that the pressure build-up in gap 170 during operation of steam generator 10 may increase to an undesirable level. Such an overpressure condition in gap 170 during operation of steam generator 10 may increase the risk, although remote, that the structural integrity of tube 40 may be compromised to the extent that tube 40 may no longer remain leak-tight. Of course, it is important that tube 40 remain leak-tight for segregating the radioactive primary fluid from the non-radioactive secondary fluid. Therefore, it is important that moisture in gap 170 and in any cracks in inside surface 50 be removed or evaporated away (i.e., boiled) to avoid an overpressure condition in tube 40 during operation of steam generator 10.

Therefore, referring to FIGS. 1, 2 and 3, there is shown the subject matter of the present invention, which is a system, generally referred to as 180, for evaporating moisture from gap 170 to obtain a quality weldment and to avoid the above-recited overpressure condition. System 180 comprises gas supply means, which may be an air compressor 190, in communication with gap 170 for supplying a gas to gap 170, as described more fully hereinbelow, at a predetermined volumetric flow rate (e.g., approximately 1404 cubic feet per minute). In addition, a first flexible conduit 200 has a first end portion 210 penetrating a manway cover 220*a* that sealingly covers manway 130*a*, such that first end portion 210 of first conduit 200 is in communication with outlet plenum 120. A second end portion 230 of conduit 200 is connected to air compressor 190, so that air compressor 190 is capable of supplying air through first conduit 200, into outlet plenum 120, into tube 40 and thence into gap 170 at a predetermined volumetric flow rate.

Referring to FIGS. 1 and 2, interposed in first conduit 200 between manway cover 220*a* and air compressor 190 may be heater means, such as a heater 240, for heating the air supplied by air compressor 190 to a predetermined temperature. Heater 240 will heat the air in conduit 200 to a predetermined temperature in order to evaporate moisture residing in gap 170. In addition, interposed in first conduit 200 between heater 240 and manway cover 220*a*, so as to be in communication with the heated air flowing through first conduit 200, is a dryer for drying the air flowing through first conduit 200. To accomplish its drying function, dryer 250 includes an adsorbative desiccant to remove water vapor from the air and provide a desired "dew point temperature", which is usually expressed as the temperature at which water vapor is in equilibrium with liquid water as explained more fully herein below. The adsorbative desiccant may be, for example, a plurality of water resistant spherical beads made of aluminosilicate. Moreover, interposed in first conduit 200 between dryer 250 and manway cover 220*a*, so as to be in communication with the dry and heated air flowing through first conduit 200, is a filter 260 for removing particulate matter (e.g., dirt/dust) and bulk liquids from the air in first conduit 200 by means of a centrifuge and a scrubber element (not shown) belonging to filter 260. In addition, filter 260 may further include a high efficiency coalescing element for removing submicron oil and water aerosols.

Still referring to FIGS. 1 and 2, a second flexible conduit 270 has a first end portion 280 penetrating manway cover 220*b* which sealingly covers manway 130*b*, such that first end portion 280 of second conduit 279 is in communication with inlet plenum 110. Second conduit 270 has a second end portion 285 connected to vacuum means, such as a vacuum pump 290, for decreasing the pressure in second conduit 270. Decreasing the pressure in conduit 270 will evaporate substantially all the moisture from gap 170, as described in more detail hereinbelow. It is known that the moisture in gap 170 inherently has what is termed in the art as the previously defined "dew point temperature". In other words, the dew point temperature is the temperature at which water vapor begins to condense on a cooled surface and is equivalent to its partial vapor pressure. If the partial vapor pressure of water is less than its saturation pressure, then more water will evaporate into the gas phase than will condense from it. Thus, the evaporating (i.e., boiling) temperature for any liquid may be controlled by the pressure placed upon the liquid, assuming a constant temperature. That is, at a constant temperature, if the pressure acting on the liquid is lowered, then the boiling temperature is lowered and more of the liquid will evaporate into the gas phase. Therefore, vacuum pump 290 decreases the air pressure in tube 40 while heater 240 maintains constant temperature in order to evaporate substantially all the moisture from gap 170.

Referring to FIG. 2, a pressure indicator 300 is connected to second conduit 270 for indicating the pressure of the air in gap 170 by monitoring the air pressure in second conduit 270. In addition, a temperature indicator 310 is connected to conduit 270 for indicating the temperature of the air in gap 170 by monitoring the air temperature in second conduit 270. Moreover, a dew point temperature indicator 320 is connected to conduit 270 for indicting the dew point temperature of the air in gap 170 by monitoring the dew point temperature of the air in second conduit 270. Alternatively, a relative humidity indicator capable of indicating the relative humidity of the air may be substituted for dew point indicator 320, if desired. An air compressor 190, dryer 250 and filter 260 suitable for use in system 180 may a "MODEL #D23C16 Air System" available from Graham-White Manufacturing Company, located in Salem, Va.

OPERATION

Steam generator 10 is removed from service and the primary fluid drained to allow access to sleeve 160, which has been previously hydraulically expanded into engagement with inside surface 50 of tube 40. Sleeve 160 is again hydraulically expanded so that sleeve 160 covers any cracks in the previously mentioned hydraulic expansion transition region 165. Sleeve 160 is then welded to tube 40 by a suitable welding device, such as a laser welding device (not shown), for sealingly affixing sleeve 160 to tube 40. However, after steam generator 10 has been removed from service and the primary fluid drained, liquid water or a liquid water/steam mixture may nonetheless remain in gap 170. Therefore, before the hydraulic expansion transition region 165 of sleeve 160 is radially expanded and before sleeve 160 is welded to tube 40, moisture (i.e., liquid water or water/steam mixture) residing in annular gap 170 is preferably evaporated by use of the invention to ensure a quality weldment.

Figure 4:
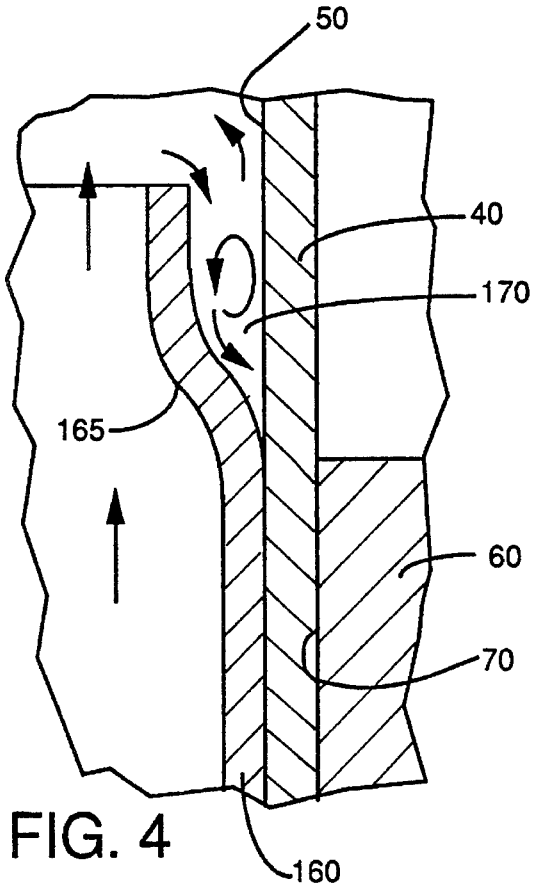
FIG. 4 is a view in vertical section of the sleeve engaging the tube, and showing the flow direction of heated air circulating through the gap to evaporate moisture from the gap.

In this regard, first end portion 210 of first conduit 200 is connected to manway cover 220*a* such that it is in communication outlet plenum 120. Second end 230 of first conduit 200 is connected to air compressor 190. Air compressor 190 is then operated to supply air to outlet plenum 120 and into tube 40 so that the air circulates through gap 170, generally in the direction of the arrows shown in FIG. 4. As air is supplied into first conduit 200, it is preferably heated by heater 240 to increase the temperature of the air entering gap 170 to a constant temperature, so that the evaporation of the moisture in gap 170 into the heated air is enhanced.

As the air flowing through first conduit 200 is heated by heater 240, the adsorbative desiccant of dryer 250 will adsorb water vapor from the air and provide the desired predetermined dew point temperature (i.e., −40° F. atmospheric dew point). Moreover, as the air flows through first conduit 200, filter 260 will remove particulate matter (e.g., dirt/dust) and bulk liquids from the air by centrifugal action and a scrubber element (not shown). From filter 260, the heated and dryer air now flows into outlet plenum 120 and from there into tube 40 whereupon it circulates into gap 170 generally in the direction of the arrows shown in FIGS. 3 and 4. From gap 170, the air travels through the remainder of tube 40 and into inlet plenum 110 where it exits steam generator 10.

Although the above-recited process evaporates a substantial amount of moisture from gap 170, some moisture may nonetheless condense into gap 170 when steam generator 10 returns to a lower ambient temperature. If desired, this remaining moisture can be substantially completely evaporated by use of vacuum means, in the manner disclosed immediately hereinbelow.

In this regard, first end portion 280 of second conduit 270 is connected to manway cover 220*b*, such that it is in communication with inlet plenum 110. Second end portion 285 of second conduit 270 is connected to vacuum pump 290. Vacuum pump 290 may then be operated to evaporate liquid water which may have condensed into gap 170. That is, as vacuum pump 290 operates, it will substantially decrease the pressure of the heated air in tube 40 and thus gap 170. As the air pressure decreases (while the temperature in tube 40 remains constant), the boiling temperature of the water in gap 170 is lowered. As the boiling temperature is lowered, substantially all the moisture in gap 170 evaporates into the heated dry air. Moreover, as the pressure decreases at constant temperature, the dew point temperature is monitored. Of course, a dew point temperature of 0° F. or lower will indicate that substantially all moisture has been removed from steam generator 10 and thus from gap 170.

The operator of system 180 can monitor the pressure of the air in tube 40 by observing pressure indicator 300. In addition, the operator of system 180 can monitor the temperature of the heated air in tube 40 by observing temperature indicator 310. Moreover, the dew point temperature of the air can be monitored by the operator of system 180 by observing dew point indicator 320. After the desired dew point temperature has been obtained, sleeve 160 may then be welded to tube 40 so as to achieve a quality weldment because substantially all the moisture has been removed from gap 170.

By way of example only and not by way of limitation, steam generator 10 may be a "MODEL E" nuclear steam generator available from the Westinghouse Electric Corporation, located in Pittsburgh, Pa. Such a steam generator 10 has approximately 4,864 "INCONEL 690" heat transfer tubes 40 with each heat transfer tube 40 having an inside diameter of about 0.664 inch. The repair sleeve 160, which may also be "INCONEL 690", has an outside diameter of about 0.640 inch forming an annular gap 170 between the sleeve 160 and tube 40 of about 0.012 inch. Such a gap 170 has a height of about six inches above the hydraulic expansion transition region 165 after initial hydraulic expansion of the sleeve into engagement with the tube.

It will be appreciated from the description hereinabove that an advantage of the present invention is that substantially all the moisture in the gap 170 (including cracks in inside surface 50) is evaporated in order to form a quality weldment joining the sleeve 160 to the tube 40 the first time a weldment is attempted.

Although the invention is illustrated and described herein in its preferred embodiment, it is not intended that the invention as illustrated and described be limited to the details shown, because various modifications may be obtained with respect to the invention without departing from the spirit of the invention or the scope of equivalents thereof. For example, the invention is described herein for evaporating moisture from a gap defined between a heat transfer tube surrounding a repair sleeve in a nuclear steam generator vessel. However, the invention is suitable for evaporating moisture from any similar gap defined between a first structure and an adjacent second structure disposed in a vessel of any type.

Therefore, what is provided are a system and method for evaporating moisture from a gap defined between a first tubular member, such as a heat transfer tube, surrounding a second tubular member, such as a repair sleeve, in a nuclear steam generator.

What is claimed is:

1. For use in association with a vessel belonging to a nuclear steam supply system, the vessel having a first tubular member disposed therein surrounding a second tubular member, the first tubular member and the second tubular member defining a gap therebetween having moisture residing therein, a system for evaporating the moisture from the gap, comprising:

(a) gas supply means in communication with the gap for supplying a gas to the gap; and (b) dryer means in communication with said gas supply means for drying the gas supplied to the gap.

2. The system of claim 1, further comprising heater means in communication with said gas supply means for heating the gas supplied to the gap, so that the moisture residing in the gap evaporates into the heated gas.

3. The system of claim 1, further comprising vacuum means in communication with the gap for decreasing the pressure of the heated gas in the gap, so that substantially all the moisture evaporates from the gap and into the heated gas.

4. For use in association with a heat exchanger vessel belonging to a nuclear steam supply system, the heat exchanger vessel having a heat transfer tube disposed therein surrounding a sleeve, the tube and the sleeve defining an annular gap therebetween having moisture residing therein, a system for evaporating the moisture from the gap, comprising:

(a) a gas compressor in communication with the gap for supplying a gas to the gap at a predetermined volumetric flow rate; and (b) a dryer in communication with said gas compressor for drying the gas.

5. The system of claim 4, further comprising a heater in communication with said gas compressor for heating the gas supplied to the gap, so that the gas is heated to a predetermined temperature and so that the moisture residing in the gap evaporates into the heated gas as the gas is heated to the predetermined temperature, the moisture evaporated into the heated gas having a dew point temperature.

6. The system of claim 4, further comprising a vacuum pump in communication with the gap for reducing the pressure of the heated gas in the gap to decrease the dew point temperature to a predetermined dew point temperature, so that substantially all the moisture residing in the gap evaporates into the heated gas as the dew point temperature decreases to the predetermined dew point temperature.

7. The system of claim 4, further comprising a pressure indicator in communication with the heated gas in the gap for indicating the pressure of the heated gas in the gap.

8. The system of claim 4, further comprising a temperature indicator in communication with the heated gas in the gap for indicating the temperature of the heated gas in the gap.

9. For use in association with a heat exchanger vessel belonging to a nuclear steam supply system, the heat exchanger vessel having a heat transfer tube disposed therein surrounding a repair sleeve engaging the tube, the tube and the sleeve defining an annular gap therebetween having moisture residing therein, the tube having a first open end and a second open end, a system for evaporating the moisture from the gap to prepare the sleeve for welding to the tube, the system comprising:

(a) a first conduit having a first end portion in communication with the first open end of the tube and having a second end portion;

(b) an air compressor connected to the second end portion of said first conduit for supplying air through said first conduit, into the tube and to the gap at a predetermined volumetric flow rate;

(c) a dryer connected to said air compressor, said dryer having an adsorbent desiccant therein for drying the air supplied by said air compressor;

(d) a heater connected to said air compressor for heating the air supplied to the gap by said air compressor, so that the air is heated to a predetermined temperature and so that the moisture residing in the gap evaporates into the heated gas as the air is heated to the predetermined temperature, the moisture evaporated into the heated air having a dew point temperature;

(e) a second conduit having a first end portion connected to the second open end of the tube and having a second end portion; and (f) a vacuum pump connected to the second end portion of said second conduit for reducing the pressure of the air in the gap to decrease the dew point temperature to a predetermined dew point temperature, so that substantially all the moisture residing in the gap evaporates into the heated air as the dew point temperature decreases to the predetermined dew point temperature.

10. The system of claim 9, (a) wherein said air compressor supplies the heated air to said first conduit at the predetermined volumetric flow rate of approximately 1,400 cubic feet per minute;

(b) wherein said heater heats the air in said first conduit to the predetermined temperature of approximately 300° F.; and (c) wherein said vacuum pump reduces the pressure in the gap to decrease the dew point temperature to the predetermined dew point temperature of approximately 0° F., whereby substantially all the moisture in the gap evaporates as the air compressor supplies the air at the predetermined volumetric flow rate, as the heater heats the air to the predetermined temperature and as the vacuum pump decreases the dew point temperature to the predetermined dew point temperature.

11. The system of claim 9, further comprising:

(a) a pressure indicator in communication with the heated air for indicating the pressure of the heated air; and (b) a dew point temperature indicator in communication with the heated air for indicating the dew point temperature of the heated air.

12. For use in association with a vessel belonging to a nuclear steam supply system, the vessel having a first tubular member disposed therein surrounding a second tubular member, the first tubular member and the second tubular member defining a gap therebetween having moisture residing therein, a method of evaporating the moisture from the gap, comprising the steps of:

(a) supplying a gas to the gap by operating a gas compressor in communication with the gap; and (b) drying the gas supplied to the gap by operating a dryer in communication with the gas compressor.

13. The method of claim 12, further comprising the step of heating the gas supplied to the gap by operating a heater in communication with the gas compressor, so that the moisture residing in the gap evaporates into the heated gas as the gas is heated.

14. The method of claim 12, further comprising the step of decreasing the pressure of the gas in the gap by operating a vacuum pump in communication with the gap, so that substantially all the moisture residing in the gap evaporates into the heated gas.

15. The method of claim 12, further comprising the step of indicating the pressure of the heated gas in the gap by operating a pressure indicator in communication with the heated gas in the gap;

16. The method of claim 12, further comprising the step of indicating the temperature of the heated gas in the gap by operating a temperature indicator in communication with the heated gas in the gap.

17. For use in association with a heat exchanger vessel belonging to a nuclear steam supply system, the heat exchanger vessel having a heat transfer tube disposed therein surrounding a repair sleeve engaging the tube, the tube and the sleeve defining an annular gap therebetween having moisture residing therein, the tube having a first open end and a second open end, a method of evaporating the moisture from the gap to prepare the sleeve for welding to the tube, the method comprising the steps of:

(a) connecting a first end portion of a first conduit to the first open end of the tube, the first conduit having a second end portion;

(b) supplying air through the first conduit, into the tube and to the gap at a predetermined volumetric flow rate by connecting the second end portion of the first conduit to an air compressor and operating the air compressor;

(c) drying the air supplied to the gap by operating a dryer connected to the air compressor, the dryer having an adsorbent desiccant therein for drying the air;

(d) heating the air supplied to the tube and to the gap, so that the air is heated to a predetermined temperature and so that the moisture residing in the gap evaporates into the heated air, the moisture evaporated into the heated air having a dew point temperature;

(e) connecting a first end portion of a second conduit to the second open end of the tube, the second conduit having a second end portion; and (f) decreasing the dew point temperature to a predetermined dew point temperature by reducing the pressure of the heated air in the gap by operating a vacuum pump connected to the second end portion of the second conduit, so that substantially all the moisture residing in the gap evaporates into the heated gas.

18. The method of claim 17, (a) wherein said step of supplying the air to the first conduit at the predetermined volumetric flow rate comprises the step of supplying the air to the first conduit at the predetermined flow rate of approximately 1,400 cubic feet per minute;

(b) wherein said step of heating the air in the first conduit to the predetermined temperature comprises the step of heating the air to the predetermined temperature of approximately 300° F.; and (c) wherein said step of decreasing the dew point temperature comprises the step of decreasing the dew point temperature to the predetermined dew point temperature of approximately 0° F., whereby substantially all the moisture in the gap evaporates as the air compressor supplies the air at the predetermined volumetric flow rate, as the heater heats the air to the predetermined temperature and as the vacuum pump decreases the dew point temperature to the predetermined dew point temperature.

19. The method of claim 17, further comprising the steps of:

(a) indicating the pressure of the heated air in the tube by operating a pressure indicator in communication with the heated air; and (b) indicating the dew point temperature of the heated air in the tube by operating a temperature indicator in communication with the heated air.

* * * * *